United States Patent [19]

Jones et al.

[11] Patent Number: 5,041,040

[45] Date of Patent: Aug. 20, 1991

[54] MOTORBOAT, WITHOUT DRIVER, CONTROLLED BY WATER SKIER SKIING, OR OPTIONALLY CONTROLLED BY A DRIVER

[76] Inventors: Ronald O. Jones, P.O. Box 657, Kent, Wash. 98035; Wayne T. Yutani, 10414 60th Ave. S., Seattle, Wash. 98178; David E. Bender, 28305 Glen Brook, Mission Viejo, Calif. 92692

[21] Appl. No.: 561,170

[22] Filed: Aug. 1, 1990

[51] Int. Cl.[5] ..... A63C 11/10

[52] U.S. Cl. ..... 441/69; 114/253

[58] Field of Search ..... 441/65, 68, 69; 440/1, 440/84, 86, 87; 242/86.5 A; 116/173, 289, 28 R, 26; 114/253, 242; 340/901, 984

[56] References Cited

U.S. PATENT DOCUMENTS

| | | | |
|---|---|---|---|
| 2,776,443 | 1/1957 | Howard | 440/87 |
| 2,914,018 | 11/1959 | Schachner | 440/85 |
| 2,972,326 | 2/1961 | Simpson | 441/69 |
| 3,018,474 | 1/1962 | Cluck | 441/69 |
| 3,103,005 | 9/1963 | Hills | 441/69 |
| 3,828,717 | 8/1974 | Nichols | 440/87 |
| 4,689,611 | 8/1987 | Franklin | 441/69 |
| 4,934,972 | 6/1990 | Shumway | 441/69 |

*Primary Examiner*—Joseph F. Peters, Jr.
*Assistant Examiner*—Clifford T. Bartz
*Attorney, Agent, or Firm*—Roy E. Mattern, Jr.

[57] ABSTRACT

A motorboat is controlled by a following water skier, when he or she is solo waterskiing, without the assistance of any driver. Optionally, a driver may operate the motorboat while towing a water skier, and an observing passenger is viewing the water skier. Optionally, a driver may operate the motorboat, with or without a passenger, and not towing a water skier. Motorboat operational controls, located both at the control center of the motorboat and on the skier's tow handle include: start and stop the motor; increase or decrease of throttle settings; select cruise speeds; turn left or right; actuate horn; automatic switches to stop engine when water skier removes his or her hands from tow rope handle and/or falls. The control signals are transmitted via electronic circuit wires extending throughout the center of a tow rope assembly and beyond. Optionally, control signals are transmitted by ultra high frequencies and related signal equipment. A red warning flag automatically raises up to signal when a skier has fallen. A horn to warn others is operated by the water skier and/or by the driver. Also this horn is automatically and intermittently operated after a preset time period passes and the motorboat is not started, to thereby indicate to other people possibly in an area, that a water skier has fallen and he or she may be in the need of assistance.

12 Claims, 7 Drawing Sheets

MOTORBOAT, WITHOUT DRIVER, CONTROLLED BY WATER SKIER SKIING, OR OPTIONALLY CONTROLLED BY A DRIVER

BACKGROUND

In 1957, U.S. Pat. No. 2,776,443 was issued to Lauren A. Howard for his water skiing apparatus. At that time he stated a water skier had no control over the towing craft, other than by shouts and gestures to a second person in the tow craft, who directed its course and controlled its speed. He therefore provided his catamaran, powered by an outboard engine, and controlled by the water skier, being towed by this powered towing catamaran. Mr. Howard utilized Bowden wire cables protected within a casing, along with a tow line cable, to serve in transmitting the water skier's initiated control movements to the controls on the catamaran.

In 1959 Kurt Schachner and Helmut Stieger in their U.S. Pat. No. 2,914,018, illustrated and described their water-borne motor-powered towing device for control by a water skier. The water skier in skiing behind the watercraft held onto a tubular rod, rotatable from water level and upwardly in a vertical plane. Control cables for ignition, starter, and throttle, were installed in the tubular rod. When skiing, the water skier, via this tubular rod, and these controls, guided, steered, and further controlled the towing watercraft. In one embodiment of their watercraft, the tubular rod and controls were removed, a seat was installed, and a driver used this watercraft solely as a power boat.

In 1961, Lee S. Simpson in his U.S. Pat. No. 2,972,326 disclosed his tow vehicle for water skiers. The towed water skier had complete control of the tow vehicle via a pneumatic system having compressed air flowing in tubes within the tow rope. If the water skier fell, automatic controls stopped the engine of the watercraft, i.e. the tow vehicle.

In 1962, James C. Moore in his U.S. Pat. No. 3,062,172 described and illustrated his motor-driven water ski towing device having a rigid extending elongated handle used by the water skier in controlling the watercraft, in turn towing the water skier.

In 1965, Branko R. Perkut in his U.S. Pat. No. 3,181,493, disclosed his water skiing apparatus having a stiff connecting element located between the boat and the water skier, and having controls used by the water skier to control the boat.

In 1973, John V. Murphy in his U.S. Pat. No. 3,745,962 illustrated and described his motorized ski towing unit. He used an outboard motor with a flotation unit essentially directly connected to water skiis, whereby the water skier had control over the operation of the outboard motor. If the water skier fell, spring actuated valves no longer held open by the water skier effectively closed the air intake to the carburetor of the outboard motor to stop the motor and consequently to stop the towing unit.

In 1973, Alphons Francis in his U.S. Pat. No. 3,763,817 described and illustrated his tow-craft for a swimmer. Water was taken inside the tow-craft and driven by a propeller located inside a tube, in turn inside the tow-craft, for discharge at the stern to propel the tow-craft. The swimmer being pulled by the tow craft held on to a handlebar. The swimmer controlled the tow craft by operating controls located nearby the handlebar.

In 1974, Ronald A. Nichols and George Rakuson in their U.S. Pat. No. 3,828,717 disclosed their water skiing apparatus to tow a water skier, who had complete control of the operation of this water skiing apparatus. The tow line contained hydraulic lines serving to convey directional and speed signals, and an electrical circuit for starting and stopping the engine. A water pump was driven by the engine and the discharge of the water was directionally controlled by an adjustable discharge nozzle. When the towed water skier is away from shore and tired, he or she may climb aboard this boat and pilot this water skiing apparatus to shore.

In 1974 Miroslav Uroshevich in his U.S. Pat. No. 3,857,354 disclosed his chassis for water ski towing device having an essentially rigid tow bar gripped by a water skier, who controlled this water ski towing device.

In 1975 Richard T. Powers in his U.S. Pat. No. 3,899,993 disclosed his improved tow bar assembly for a water ski towing device used with Miroslav Uroshevich's chassis for water ski towing device, as shown in his U.S. Pat. No. 3,857,354.

These inventors provided water skiers with watercraft they could control when they were skiing behind them. Other inventors have provided safety apparatus for watercraft which are useful or could be useful in conjunction with water skiing.

In 1932, Robert H. Tobener Jr. provided a throttle ignition switch which would turn off, if a driver of a boat unintentionally fell out of the boat.

In 1971 Daniel M. Penaflor in his U.S. Pat. No. 3,602,188 disclosed his ski boat warning apparatus, which automatically raised a flag when a water skier released the ski tow rope.

In 1974 Donald C. Langford in his U.S. Pat. No. 3,798,631 disclosed his water skier alarm system, which produced an audible alarm when a water skier fell. The audible alarm continued until a flag was raised to indicate to other persons in possible nearby boats, that a water skier was in the water.

In 1988 Cheryl G. Little in her U.S. Pat. No. 4,782,784 illustrated and described her motorized boat mounted signaling device for water skiers. When a water skier fell and was in the water, a flag was raised either automatically upon release of the tow rope by the water skier, or directly by a driver and/or passenger in the towing watercraft.

In 1987 Steven H. Lugo in his U.S. Pat. No. 4,640,213 described and illustrated his signal flag apparatus for water skiing. An automatic mechanism held the warning flag down when the water skier applied tension on the tow rope, and quickly raised the flag in the absence of the water skier's applied tension force, when he or she fell.

In 1986 James R. Solean in his U.S. Pat. No. 4,624,141 described and illustrated his towrope-handling system monitor for waterskiing. When a water skier fell an alarm sounded in the tow boat to warn the driver the water skier had fallen. The alarm was triggered upon loss of tension in the tow rope and/or upon the towrope handle dropping into the water to complete an electrical circuit. An indicator in the towing watercraft recorded the relative position of the water skier with this watercraft at the time the water skier fell.

In 1984, Ronald S. Alley, Sr. in his U.S. Pat. No. 4,483,683 disclosed his ski tow signal assembly, which could be actuated by the water skier by his or her direct command, or indirectly when he or she fell when waterskiing. The radio signals created caused a horn to sound and a rotary strobe light to function.

In addition to safety devices, other inventors have provided improvements for small powered watercraft. In 1987, Katumi Watanable in his U.S. Pat. No. 4,708,671 described and illustrated his watercraft with a thrust-reversing device.

In 1986, Mitsuhiro Yazski in his U.S. Pat. No. 4,568,293 disclosed his air intake arrangement for a small boat, which had an engine driving a water jet propulsion device.

In 1988, Messrs. Konomu Murakami and Hiroshi Nishida illustrated and described their deck construction of a small boat to support an operator thereof in a standing or seated position.

All these prior inventors and many other inventors concerned with the provision of smaller watercraft for high performances, and especially those inventors concerned with providing water skiers with better ski towing watercraft have presented excellent watercraft and controls therefor. However, there has remained a need for a smaller watercraft to serve a combination of needs, commencing with the primary need of watercraft to be controlled directly by a water skier in a very safe way. Then a need to provide these watercraft to carry two persons, when they would then be operating this watercraft to pull a water skier. Thereafter a need to provide the watercraft to carry one or two persons, when they were operating the watercraft to be just motorboating or speedboating by themselves and not pulling a water skier.

SUMMARY

A motorboat is available for a water skier to operate, while he or she is water skiing behind it, while providing more safety equipment and conveniences than previously available with respect to other motorboats. Also when a driver and an observer are available, they may join the water skier in participating in this water sport. Moreover, the motorboat with the driver alone or with a passenger, is available, when water skiing times are completed, to continue on with just enjoying motorboating. In reference to previously available motorboats, controllable by the water skier water skiing behind such motorboats, this motorboat: has a longer and wider hull; is operated, as noted, either as a skier operated tow craft or as a sit down personal watercraft; has electronic or ultra high frequency controls initiated by the water skier; has a lightweight tow handle; has optional preset skiing speeds; has a horn for direct sounding by a water skier or driver of this motorboat, or for sounding, automatically and intermittently, when a water skier has fallen and not restarted the engine of the motorboat, after a preset time; has a three mode engine stopping kill switch circuit, automatically actuated by a water skier who has fallen while skiing solo, as this water skier's body, via a tether, pulls out an electrical plug to break a circuit, automatically actuated as a water skier, via his or her hand, releases a parallel, spring biased, bar built into the tow handle, or automatically actuated as a driver, via his or her hand, releases a parallel, spring biased bar built into the driver's steering controls; and has a colored warning flag which automatically raises, to thereby indicate to observers that a water skier has fallen.

BRIEF DESCRIPTION OF THE DRAWINGS

The motorboat, without a driver, controlled by a water skier being pulled by this motorboat, or optionally controlled by a driver and carrying an observing passenger viewing the water skier being pulled by this motorboat, is illustrated in the drawings, wherein.

DESCRIPTION OF THE PREFERRED EMBODIMENTS

Modes of Use of Motorboat

Figure 10:
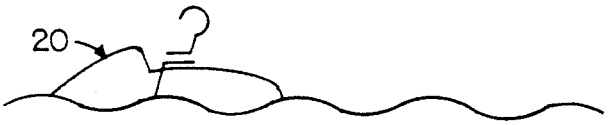
FIG. 10 is a schematic side view of the motorboat having one person at the controls, and no water skier is being towed.
Figure 11:
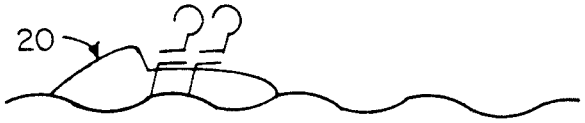
FIG. 11 is a schematic side view of the motorboat having two persons on the motorboat with one person at the controls and the other person being a passenger, while facing forwardly, and no water skier is being towed.
Figure 12:
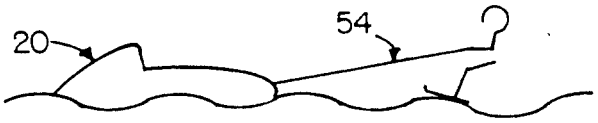
FIG. 12 is a schematic side view illustrating the motorboat towing the water skier, who is controlling the operation of the motorboat.
Figure 13:
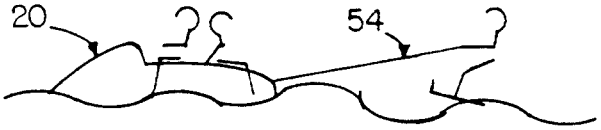
FIG. 13 is a schematic side view illustrating the motorboat with a person on the motorboat controlling its operation, and another person on the motorboat facing rearwardly to view the water skier.

The motorboat 20, without a driver, and operating while controlled by a water skier, when he or she is skiing behind it, is illustrated in FIGS. 1 through 9 and 12. Also, as shown in FIG. 13, a driver and an observing passenger may be aboard this motorboat 20, when a water skier is being towed behind it. Then, as shown in FIGS. 10 and 11, one or two persons may be aboard, while this motorboat 20 is being operated without towing a water skier.

General Configuration of Motorboat

As shown in FIGS. 1 through 7, the motorboat 20 has a hull bottom 22 with starboard and port sponson like portions 24, 26 creating a central tunnel 28, interrupted nearer the stern and at the stern 30 by the propulsion water discharge portion 32. At this discharge locale is the propulsion water discharge opening 34. Directly adjacent this opening an adjustable, multiple direction, market available nozzle assembly 36 is illustrated, only in FIG. 3 with dotted lines. Also installed is a thrust reversing unit 38, shown in dotted lines in its upward retracted position in FIG. 3. It is lowered when needed to reverse the direction of the discharging propulsion water.

The hull top 40 has a spray and wind deflecting entry portion 42 gradually raising to a control mounting portion 44. Beyond and extending to the stern 30 is a seating portion 46 for a driver and a passenger.

In one specific size embodiment of this motorboat 20, having the hull 48 made of fiberglass laid up portions and molded plastic portions, without and with wood and/or other reinforcements, the length is 8' and 9"; width 3' and 8"; and height 2' and 8". This overall size provides a motorboat 20, which is used in the four ways illustrated in FIGS. 10 through 13.

Inside the hull 48, commercially available components, not shown, are installed. For example, in a specific embodiment, a three cylinder, two stroke, gas engine of 638 cubic inches of displacement serves as the power plant to produce 85 horsepower at 6,750 r.p.m. This engine drives an axial flow jet pump, which discharges the propulsion water through the multiple direction nozzle assembly.

There is a constant siphon automatic bilge draining unit, and a fuel tank of ten gallons to receive a fuel/oil mix of 50 to 1, holding one of the ten gallons in reserve, to be intentionally used, upon turning of a valve, to get back to a starting place where fuel is available again.

General Configuration of the Tow Rope and Tow Handle With Controls

Figure 8:
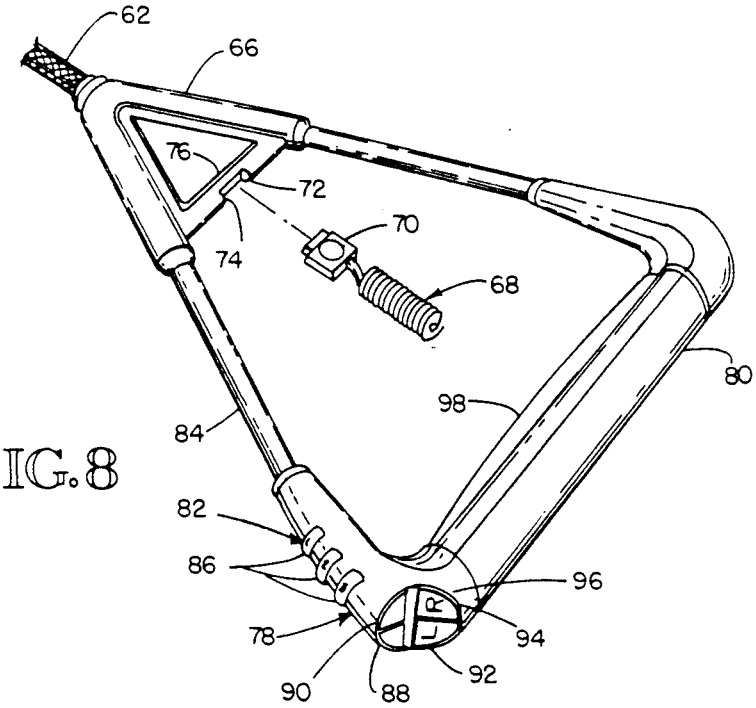
FIG. 8 is an enlarged perspective view of the water skier's tow handle assembly, showing the location of the controls operated by the water skier to maneuver the motorboat and the pull out safety electrical plug, which is autocratically removed when a water skier falls, to break an electrical circuit stopping the engine of the motorboat.
Figure 9:
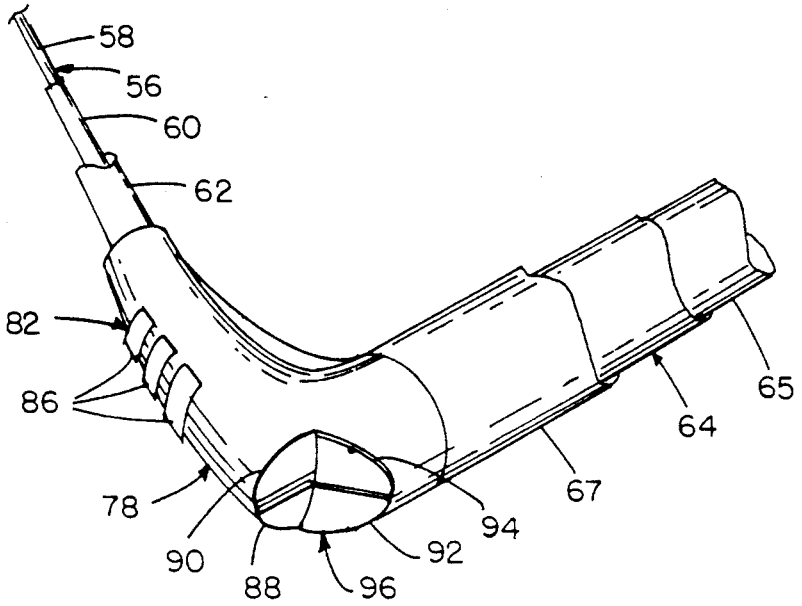
FIG. 9 is an enlarged view of the tow rope assembly illustrating the assembly of the electrical wires, the protector of the wires, and the rope portions, and also showing the assembly of the hand gripping portions of the water skier's tow handle, indicating the buoyant interior material, and the other safety switch for hand gripping to keep the engine ignition circuit active as long as the water skier's hands are still gripping this tow handle.

As shown in FIGS. 8 and 9, the overall tow rope assembly 54, in one selected embodiment, appears essentially like a conventional tow rope, which is just rope per se. However, a somewhat larger diameter is necessary. In the center of this overall tow rope assembly 54, is a group 56 of signal transmitting wires 58. Flexible plastic tubing 60 surrounds this group 56 of wires 58 to protect them from stresses being sustained by the surrounding braided rope portions 62, which are transmitting the operational load of a following water skier being towed by the motorboat 20, which he or she is preferably controlling from his or her active water skiing positions, which are constantly changing with respect to the course of the motorboat 20.

The water skier's tow handle 64 is triangular in configuration, as illustrated in FIG. 8. In the apex portion 66 of this tow handle, the overall tow rope assembly 54 is well secured.

Also secured at this apex portion 66 is an engine stop lanyard 68 which is tethered to the water skier, so when he or she falls and drops this tow handle, the plug portion 70 of this lanyard 68 is pulled clear of the socket 72 on the tow handle 64. This interrupts the ignition circuit 74, thereby serving as a kill switch 76. This same lanyard 68 is used when a driver is unwantedly ejected from the motorboat 20, not shown.

At one corner 78 of the base 80 of this triangular configured tow handle 64 is an arrangement of the water skier's overall controls 82 for remotely operating the motorboat 20. Depending on whether a water skier is left or right handed, these overall controls 82 are either positioned to port or starboard locations, upon convenient rotation of the tow handle 64. Along a triangular side 84 of the tow handle 64, is a set 86 of three preset speed selectors to be alternately depressed by the water skier to select a water skiing cruising speed. At the juncture or corner 78 of this triangular side 84 and the base 80 of the triangular shaped tow handle 64, are four closely spaced selectors. There is a horn selector 90, a left turn selector 92, and a right turn selector 94. This grouping 96 of these four selectors is also referred to as an ambidextrous thumb control grouping 96. Extending across the base 80 of the triangular tow handle 64 is a switch bar 98, which is kept depressed by the water skier during his or her controlled water skiing time. When, however, he or she falls and lets go of tow handle 64, this switch bar 98 moves outwardly to break the ignition circuit, thereby becoming an emergency kill switch bar 98. The tow handle 64 has internal flotation material 65 and external waterproofing material 67, the latter protecting the electronic controls 82.

Signal Flag

Figure 1:
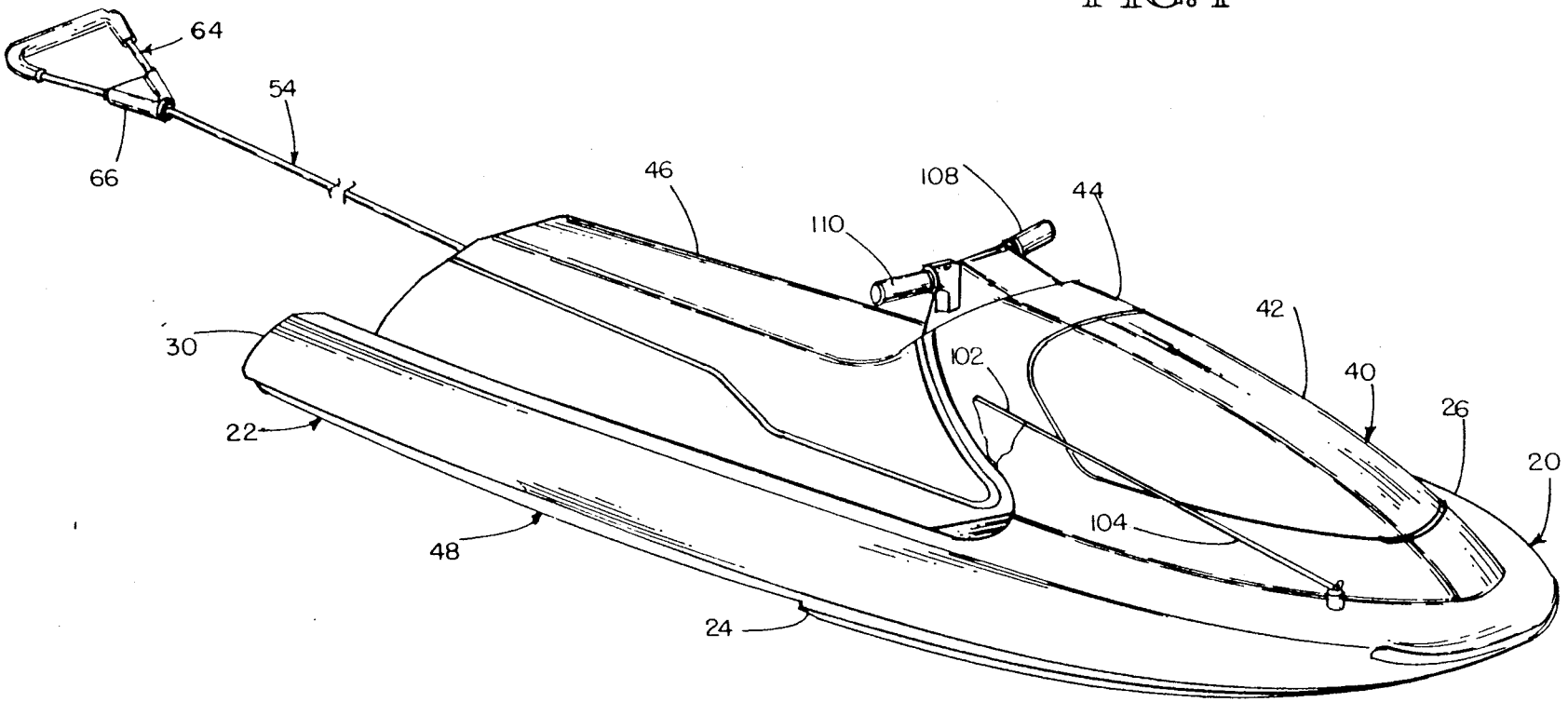
FIG. 1 is a front perspective view illustrating the motorboat, the tow rope assembly, the water skier's tow handle, and the red signal flag.
Figure 2:
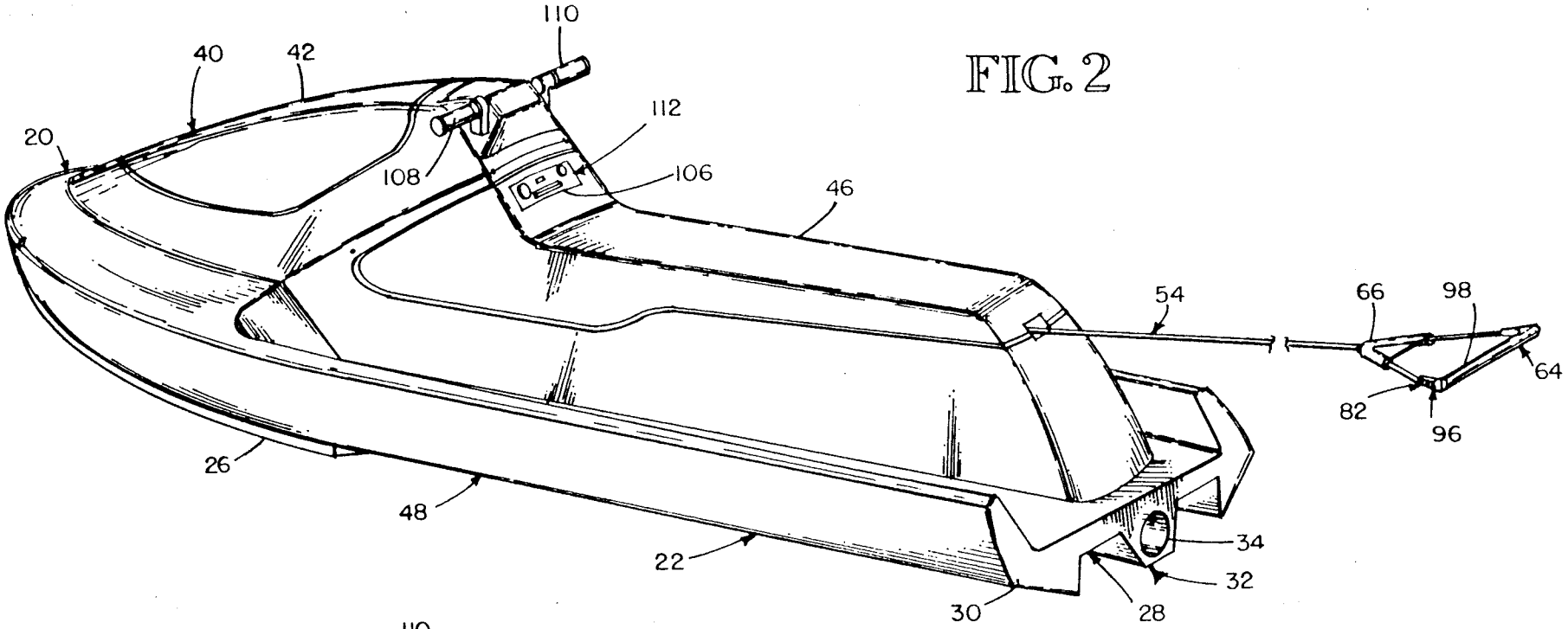
FIG. 2 is a rear perspective view of the motorboat, the tow rope assembly, and the water skier's tow handle assembly.
Figure 3:
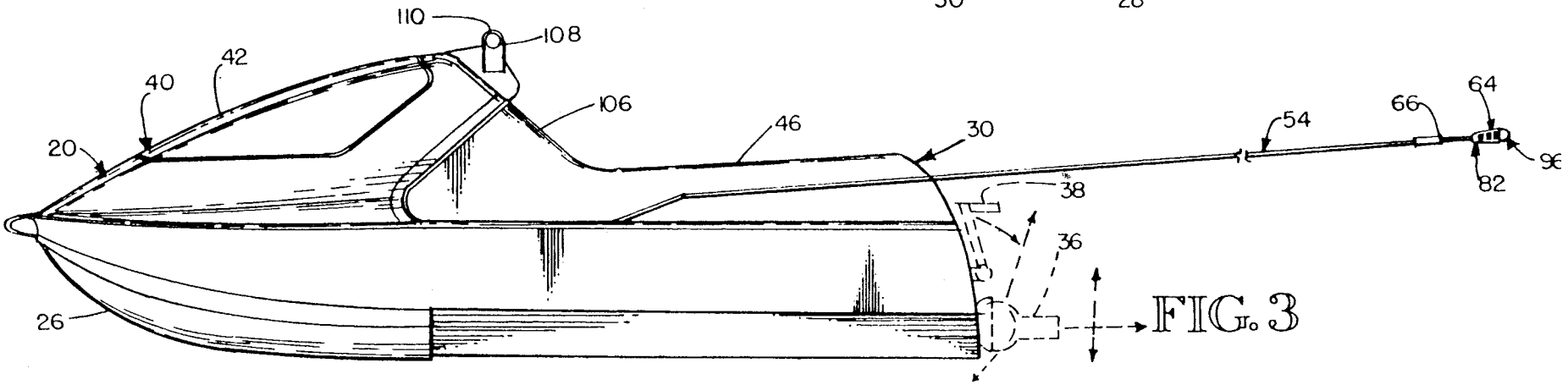
FIG. 3 is a side view of the motorboat, the tow rope assembly, the water skier's tow handle assembly, and indicating, in dotted lines only in this view, the adjustable, multiple direction nozzle assembly of the propulsion water jet pump assembly, and also indicating a retracted thrust reversal unit.
Figure 4:
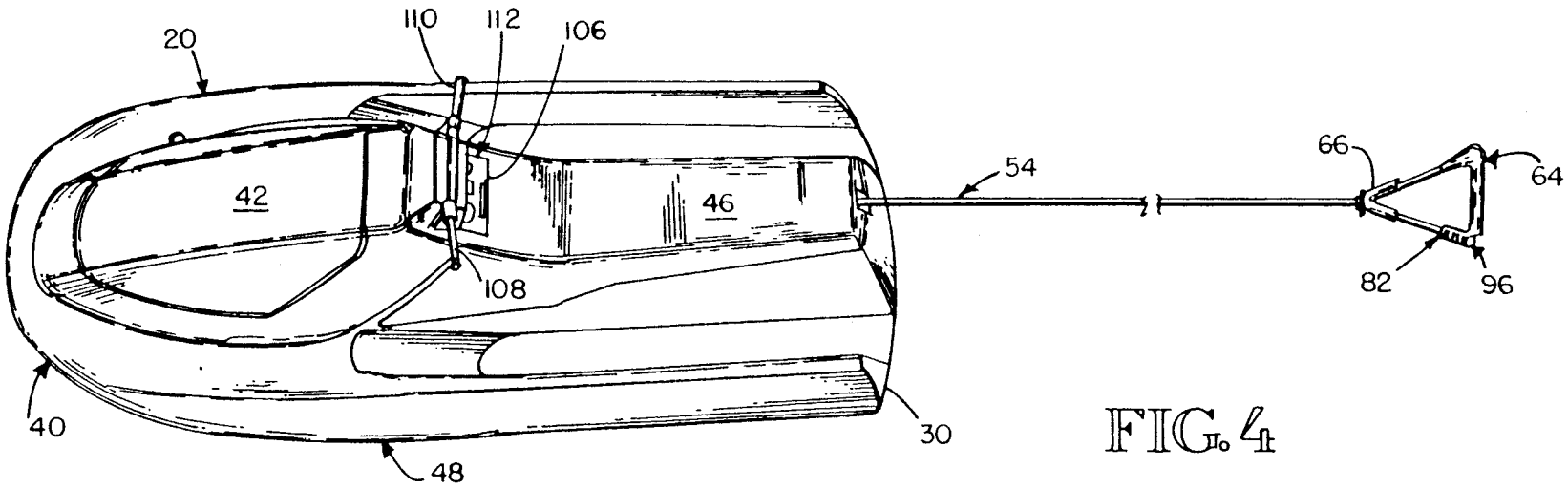
FIG. 4 is a top perspective view.
Figure 5:
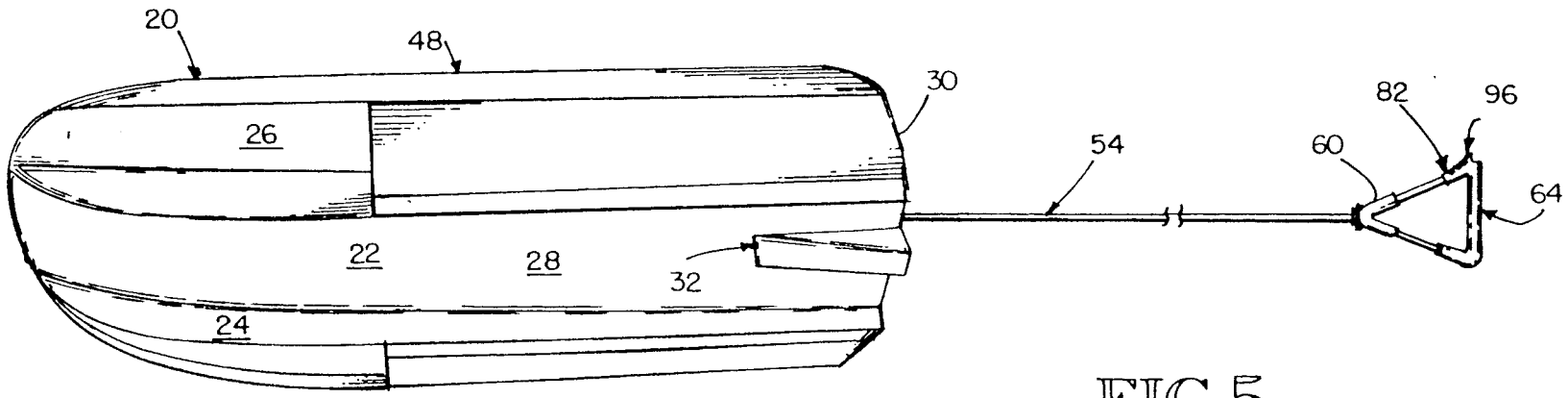
FIG. 5 is a bottom perspective view.
Figure 6:
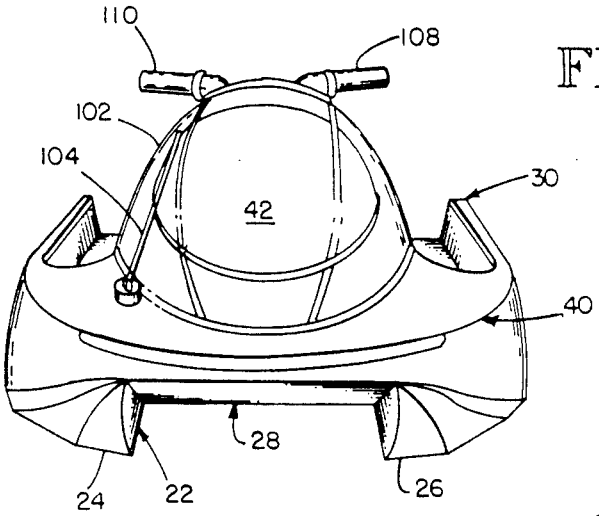
FIG. 6 is a front or bow view.
Figure 7:
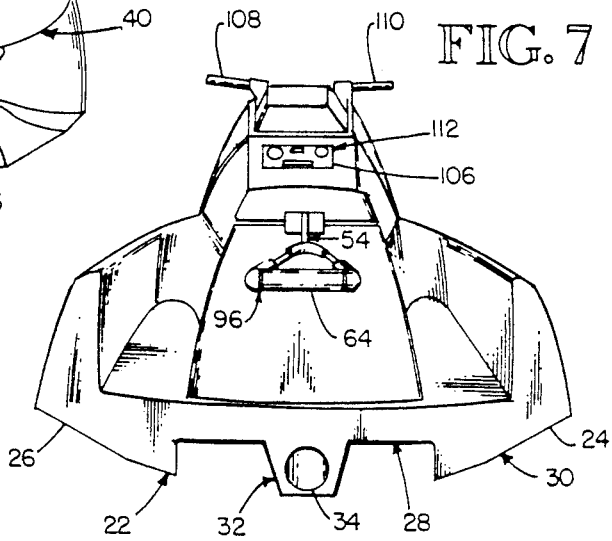
FIG. 7 is a rear or stern view.

In FIG. 1, a signal flag 102, positioned on a pivotally mounted flag staff 104, is illustrated. The positioning of this flag will comply with local laws. Generally, the signal flag 102 is raised when a water skier has fallen into the water. The raising of this flag 102 is preferably automatically undertaken during water skiing periods, when the tension load ceases in respect to the overall tow rope assembly 54.

Control Console

A control console 106 mounted in the control mounting portion 44 of the hull top 40 presents information to a driver or water skier as to the quantity of fuel, engine temperature, etc. Also at this control mounting portion 44, are starter switches, engine stop switches, throttle lever, and cruising speed controls,, not shown, and the directional control handles 108, 110.

Preferred Control Systems

The overall preferred control system 112 provides the water skier full control of the towing motorboat 20 at all times when he or she is skiing behind the motorboat during a solo skiing period. Then when the water skier unwantedly is separated from the tow handle 64 and the overall tow rope assembly 54, the motorboat 20 will automatically stop, a signal flag will be automatically raised, and if the engine of the motorboat 20 is not started within a preset time, often three minutes, a horn on the motorboat 20 sounds, often following a distinctive distress pattern of repeating sounds.

Figure 14:
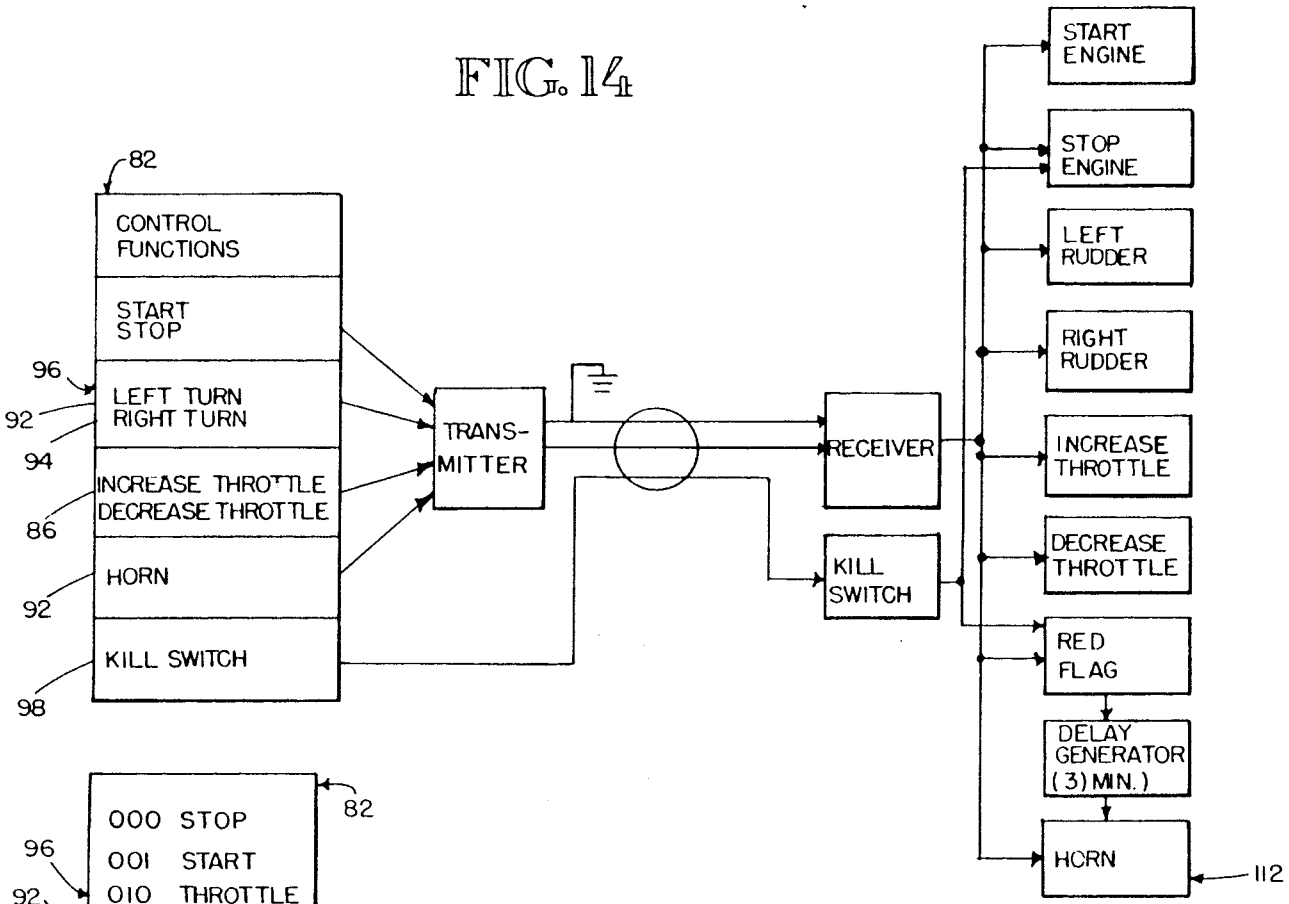
FIG. 14 is a block diagram illustrating, at the left side, the controls available to the water skier at his or her tow handle to create signals to be transmitted, via wires in the tow rope assembly, for reception at the motorboat, as shown at the right side of this FIG. 14.

In FIG. 14 a block diagram illustrates on the left side of this FIG. 14 the control functions available to the water skier at the tow handle locale. There are start engine, stop engine; left turn, right turn of a multi directional propulsion water discharge nozzle assembly; increase or decrease engine throttle settings; horn button; and a kill switch. The signals selectively initiated are transmitted, as illustrated, via electrical circuit wires 58 in a group 56 passing through the center of the overall tow rope assembly 54.

On the right side of this FIG. 14, the received signals are respectively distributed within the motorboat 20. There are comparable control functions of start engine, stop engine; left rudder, right rudder; increase throttle, decrease throttle; raise signal flag; and sound horn following a preselected delay period.

As noted, via a separate circuit are the respective kill switches at the tow handle 64, and at the motorboat 20. These kill switches automatically operate when a water skier, or a driver, unwantedly leaves his or her operating position, when continuing operations are otherwise scheduled via these preferred control systems.

Figure 15:
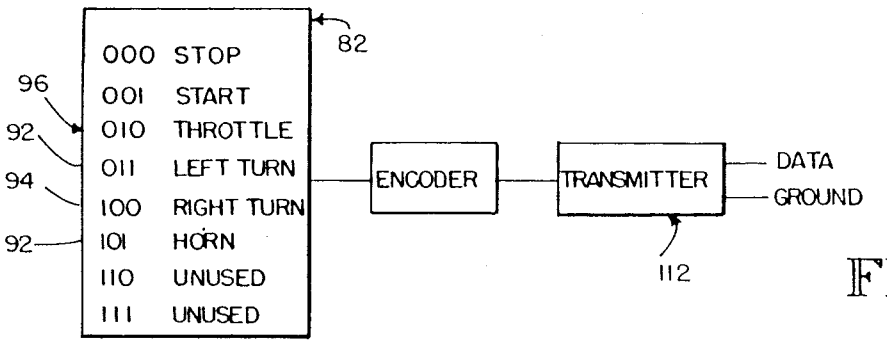
FIG. 15 is a block diagram schematically showing how computer based control systems are arranged in the tow handle, and the signals created are transmitted.

In FIG. 15 information is presented by block diagram and digital designations to illustrate how a computer based preferred control system operates. The water skier's operation of the grouping of the controls creates the digital signals which are encoded and transmitted by high frequency energy to be received and decoded and utilized, not shown.

Figure 16:
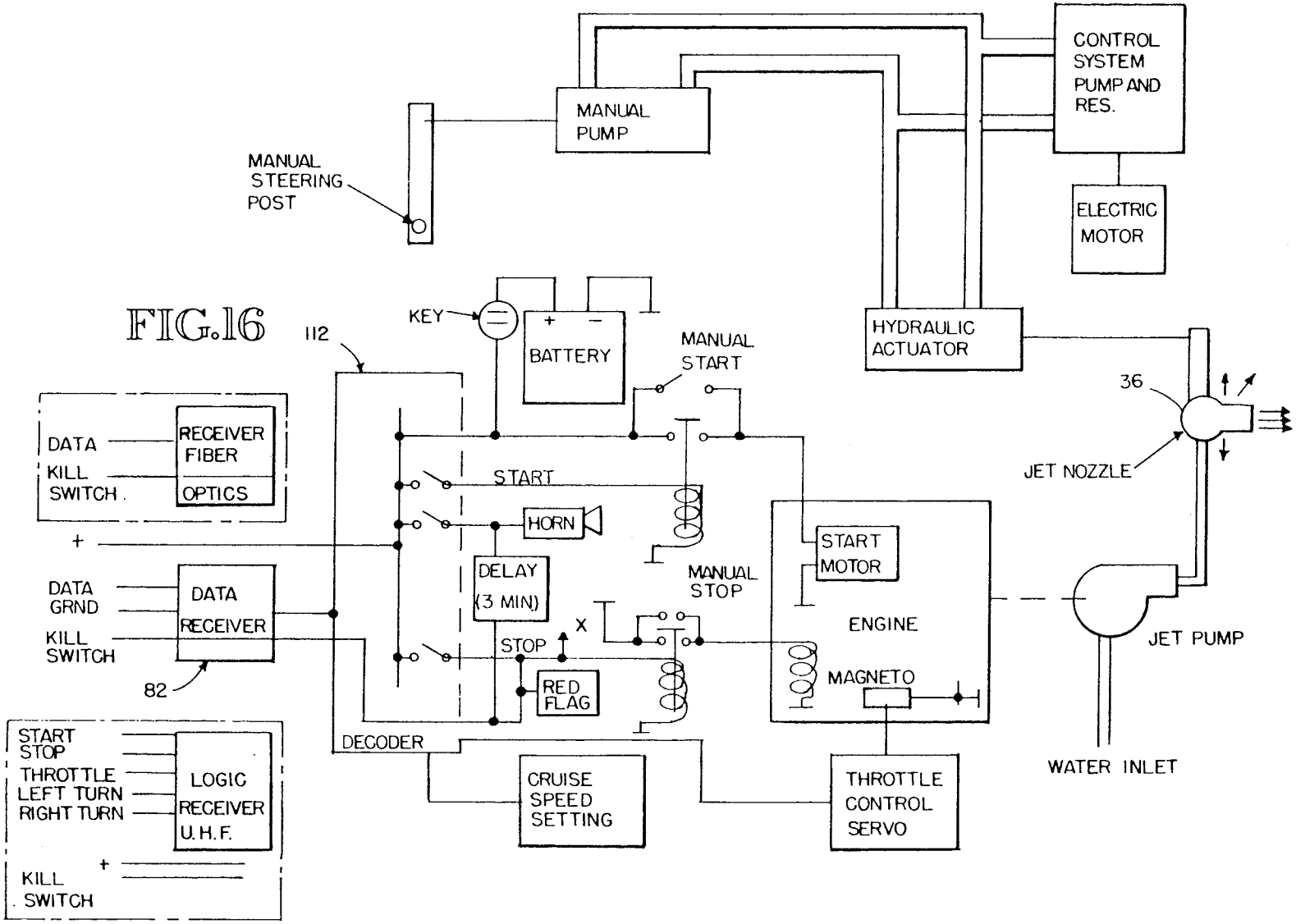
FIG. 16 is a block diagram schematically illustrating the electrical circuits and the hydraulic system, and their interconnection with respect to maneuvering the motorboat.

In FIG. 16 the interrelationship of the electrical and electronic controls with various electrical-mechanical components, and with various hydraulic components is illustrated. Referral back to FIGS. 14 and 15 is requested.

On the left side of this FIG. 16, at the mid area thereof, is the electrical signal data receiver, shown related to the overall control circuits. On this left side at the top area is an indicating diagram indicating if more resilient fiber optical cables are available some fiber optic carried signals could be alternately utilized. On the left side at the bottom area is an indicating diagram indicating how high frequency digital data could be alternately utilized.

In the central area of FIG. 16, is a circuit diagram of the electrical circuits, and related equipment, which are all installed aboard the motorboat 20. At the top area and down along the right side area of this FIG. 16 is a hydraulic diagram of the controls, which are utilized to change the direction of the jet nozzle, through which the propulsion water is discharged. The interrelationship of the signals received from the water skier to cause changes of the hydraulic directional control system, is undertaken in the illustrated control system of the electrical powered hydraulic pump, adjacent the oil reservoir. Directional oil flow valves in this control system will be operated, ultimately causing directional changes in the position of the propulsion jet nozzle.

Essentially, wherever possible market available components of all kinds will be utilized to meet the objectives in providing this motorboat, without driver, controlled by a water skier skiing, or optionally controlled by a driver.

We claim:

1. A motorboat fully controllable by a following water skier, who is enjoying this sport to the fullest extent without relying on other persons, yet if wanted, a driver and observer may be aboard to run the motorboat for him or her, comprising:

a) a hull having the buoyancy and strength to carry two persons while towing a water skier;

b) a complete propulsion assembly, comprising in turn, an engine, a water jet pump, driven by the engine and water discharge multiple direction nozzle, a fuel tank, a battery, a starter, electrical circuits, liquid conduits, and related controls for the engine and the water discharge nozzle;

c) a ski tow rope and tow handle assembly, comprising the rope as a subassembly having a center core composed of signal transmitting materials, and braided rope portions arranged about these signal transmitting materials, and the handle as a subassembly having hand gripping portions and control mounting portions, said control mounting portions having speed controls, directional controls, and safety controls; and d) an assembly of safety components, comprising in turn, a signal flag subassembly for automatic raising when a water skier has fallen into the water, a kill switch subassembly in the engine controls automatically operated when a water skier is removed from the locale of a tow handle, and a horn subassembly ready for direct use by the water skier or driver, and ready for automatic use when a water skier has fallen and needs assistance.

2. A motorboat fully controllable by a following water skier, as claimed in clair 1, wherein the hull has a bottom portion, in turn comprising starboard and port sponson portions, a central tunnel portion, a centered propulsion water discharge portion having a water discharge opening.

3. A motorboat fully controllable by a following water skier, as claimed in claim 2, wherein the hull has a top portion, in turn comprising a spray and wind deflecting entry portion, an adjacent control mounting portion, and an adjacent seating portion.

4. A motorboat fully controllable by a following water skier, as claimed in claim 1, wherein the ski tow rope and tow handle assembly in respect to the handle subassembly is arranged in a triangular shape, the base member thereof comprising a hand grip which includes a kill switch, a corner member thereof, adjacent the hand grip, housing multiple controls which are: preset speed selectors, horn button, resume speed control, and left and right turn buttons, whereby when this triangular shaped handle is turned 180 degrees, these controls become ambidextrous for the water skier's selected right or left thumb control.

5. A motorboat fully controllable by a following water skier, as claimed in claim 2, wherein the ski tow rope and tow handle assembly in respect to the handle subassembly is arranged in a triangular shape, the base member thereof comprising a hand grip which includes a kill switch, a corner member thereof, adjacent the hand grip, housing multiple controls which are: preset speed selectors, horn button, resume speed control, and left and right turn buttons, whereby when this triangular shaped handle is turned 180 degrees, these controls become ambidextrous for the water skier's selected right or left thumb control.

6. A motorboat fully controllable by a following water skier as claimed in claim 3, wherein the ski tow rope and tow handle assembly in respect to the handle subassembly is arranged in a triangular shape, the base member thereof comprising a hand grip which includes a kill switch, a corner member thereof, adjacent the hand grip, housing multiple controls which are: preset speed selectors, horn button, resume speed control, and left and right turn buttons, whereby when this triangular shaped handle is turned 180 degrees, these controls become ambidextrous for the water skier's selected right or left thumb control.

7. A motorboat fully controllable by a following water skier, as claimed in claim 2, having a multiple directional nozzle installed at the water discharge opening of the centered propulsion water discharge portion.

8. A motorboat fully controllable by a following water skier, as claimed in claim 3, having a multiple directional nozzle installed at the water discharge opening of the centered propulsion water discharge portion.

9. A motorboat fully controllable by a following water skier, as claimed in claim 5, having a multiple directional nozzle installed at the water discharge opening of the centered propulsion water discharge portion.

10. A motorboat fully controllable by a following water skier, as claimed in claim 6, having a multiple directional nozzle installed at the water discharge opening of the centered propulsion water discharge portion.

11. A motorboat fully controllable by a following water skier, as claimed in claim 9, wherein the handle subassembly has internal flotation materials and external waterproofing materials.

12. A motorboat fully controllable by a following water skier, as claimed in claim 10, wherein the handle subassembly has internal flotation materials and external waterproofing materials.

* * * * *